United States Patent [19]

Frikker

[11] Patent Number: 4,905,913

[45] Date of Patent: Mar. 6, 1990

[54] CONTOUR FOLLOWING APPARATUS FOR POSITIONING SPRAY GUNS

[75] Inventor: Jozsef Frikker, Dreieich, Fed. Rep. of Germany

[73] Assignee: DeVilbiss GmbH, Fed. Rep. of Germany

[21] Appl. No.: 333,641

[22] Filed: Apr. 5, 1989

[30] Foreign Application Priority Data

Apr. 19, 1988 [DE] Fed. Rep. of Germany ..... 3813058

[51] Int. Cl.[4] ..... B05B 13/02

[52] U.S. Cl. ..... 239/751; 239/263.1; 239/264; 239/753; 901/43; 118/323; 118/697; 427/424

[58] Field of Search ..... 239/227, 264, 587, 750–753, 239/263.1; 901/4, 17, 43; 118/323, 697; 427/424

[56] References Cited

U.S. PATENT DOCUMENTS

| | | | |
|---|---|---|---|
| 3,561,398 | 2/1971 | Rose et al. | 239/227 X |
| 3,888,360 | 6/1975 | Ando et al. | 901/17 X |
| 4,502,830 | 3/1985 | Inaba et al. | 901/17 X |
| 4,716,785 | 1/1988 | Godai et al. | 901/23 X |
| 4,836,111 | 6/1989 | Kaufmann | 104/89 |

*Primary Examiner*—Andres Kashnikow
*Assistant Examiner*—William Grant
*Attorney, Agent, or Firm*—MacMillan, Sobanski & Todd

[57] ABSTRACT

Apparatus for automatically spraying the sides and the top of workpieces such as vehicle bodies as they are conveyed through a spray station. Separate apparatus is provided for spraying the two sides and the top of the conveyed workpiece. Each apparatus is capable of moving one or more spray guns both in a direction transverse to the movement of the conveyed workpiece and towards and away from the conveyed workpiece, and of rotating the spray guns about two axes to direct the spray guns perpendicular to the surface being coated.

7 Claims, 2 Drawing Sheets

CONTOUR FOLLOWING APPARATUS FOR POSITIONING SPRAY GUNS

TECHNICAL FIELD

The invention relates to a apparatus for positioning and moving a spray gun and more particularly to improved apparatus capable of moving a spray gun in a direction transverse to the direction that a workpiece is being conveyed and at the same time to rotate the spray gun about two axes and to adjust the spacing between the spray gun and the workpiece to follow the contours of the workpiece.

BACKGROUND ART

For automatically painting vehicle bodies, for example, and other types of workpieces it is common to sequentially convey the vehicle bodies past one or more paint spray stations where the sides and the top of the vehicle body are coated. Each side of the vehicle body may be coated by one or more spray guns which are mounted on a reciprocator. As the body is conveyed in a horizontal direction past the spray guns, the reciprocator continuously moves the spray guns up and down and the spray guns are turned on to apply paint to the sides. One or more spray guns also are mounted on a top coater which reciprocates the spray guns horizontally in a transverse direction to sweep back and forth across the top of the vehicle body as the body is conveyed through the spray station for applying paint to the top.

Prior art side and top coaters of this type can apply a high quality coating to the sides and top of a box shaped workpiece, such as a refrigerator having a rectangular housing. However, most vehicle bodies have curved surfaces. The curved surfaces cause the spacing between the spray guns and the body to change and cause the angle of the surface being coated relative to the spray gun to change as the body is conveyed past the spray guns. In most cases, it is preferable to have each spray gun spray in a direction substantially perpendicular to the surface being coated.

Contour following apparatus presently used in the automobile industry for spray painting passenger car bodies is mechanically designed to follow contours to a limited extent. The apparatus is constructed to follow a single contour which represents an average for all types of car bodies to be painted by the apparatus. Thus, the spray guns can only follow a contour which represents the average and cannot follow the precise contour of each different shape car body. When the actual contour of the car body deviates significantly from the average contour followed by the coating apparatus, there is a decrease in the quality of the applied coating.

DISCLOSURE OF INVENTION

According to the invention, improved apparatus is provided for reciprocating spray guns in a direction transverse to the movement of a workpiece such as a vehicle body as the workpiece is conveyed past a spray station. In addition to the reciprocating motion, the spray guns can be moved towards and away from the workpiece and can be rotated about two axes to aim the spray gun substantially perpendicular to the surface being coated.

For coating each side of a vehicle body as the vehicle body is conveyed horizontally along the Y axis, four stationary electric motors control the position of one or more spray guns. A first of the motors is connected to move a carriage vertically up and down along the Z axis. A second of the motors is connected to move a base plate along the X axis towards and away from the surface of the vehicle body. The base plate is coupled for movement along the Z axis with the carriage. A third of the motors is connected for rotating the base plate about the Y axis and the forth motor is connected for rotating the base plate about the Z axis. The spray guns are attached to the base plate. Separate side coating apparatus is used for coating each side of the vehicle body.

Four motors also are used for coating the top of the vehicle body. For coating the top of the vehicle, a stationary first one of the motors is connected to move a frame vertically along the Z axis towards and away from the vehicle body. A second of the motors is mounted on the frame and is connected to move a carriage on the frame along the X axis which extends transverse to the direction of movement of the vehicle body. A third of the motors is mounted on the frame and is connected to rotate one or more spray guns about the X axis and the fourth of the motors is mounted on the frame and is connected to rotate the spray guns about the Y axis.

Since the transverse position of the spray guns relative to the conveyed vehicle body, the spacing from the spray guns to the vehicle body surface being coated and the rotational position of the spray guns about two axes are individually controlled by electric motors, the apparatus is freely programmable for following the contour of the vehicle body as the vehicle body is conveyed through the spray station.

BEST MODE FOR CARRYING OUT THE INVENTION

A vehicle body, or other type of workpiece, is conveyed through a paint spray station which includes three contour following apparatus according to the invention for positioning spray guns for individually coating the two sides and the top of the body. Each of the apparatus is capable of moving one or more spray guns in a direction transverse to the direction in which the vehicle body is conveyed and in a direction towards and away from the conveyed vehicle body in a direction perpendicular to both the transverse direction and the conveyed direction. The apparatus further is capable of rotating the spray guns about two perpendicular axes to permit aiming the spray guns substantially perpendicular to the a portion of the surface being coated. The spray guns are positioned along each axis by explosion proof electric motors which can be controlled by a suitable programmable controller (not shown) which does not form a part of the invention.

Figure 1:
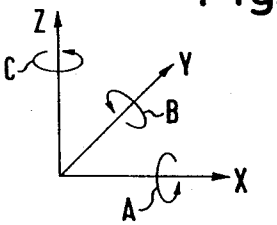
FIG. 1 is a diagram showing the three rectangular coordinate axes X, Y and Z in a three dimensional space and the three associated axes of rotation A, B and C.

FIG. 1 shows the three rectangular coordinate axes X, Y and Z. For the following description of the invention, it will be assumed that a vehicle body is conveyed horizontally along the Y axis, that the Z axis extends vertically and that the X axis extends horizontally in a direction perpendicular to both the Y and the Z axes. For coating the sides of a vehicle body as the vehicle body is conveyed along the Y axis, the spray guns are reciprocated vertically along the Z axis and moved towards and away from the body along the X axis to maintain a desired spacing between the spray gun nozzles and the surface being coated. Further, the spray guns are rotated about the Y and Z axes for aiming the spray guns towards the side surface being coated. For coating the top of the vehicle body, the spray guns are reciprocated along the X axis in a direction transverse to the direction that the body is conveyed and vertically along the Z axis towards and away from the body to maintain a desired spacing between the spray gun nozzles and the surface being coated. Further, the spray guns are rotated about the X and Y axes for aiming the spray guns towards the portion of the top surface being coated.

Figure 2:
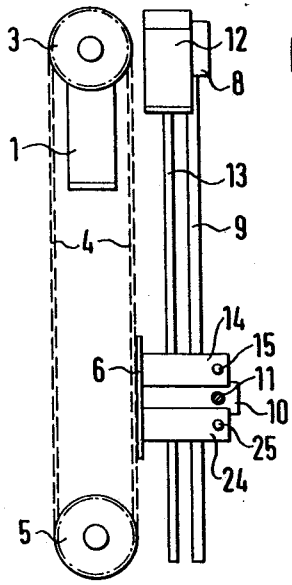
FIG. 2 is a diagrammatic side elevational view showing contour following apparatus for spraying the side of a vehicle body in accordance with the invention.
Figure 3:
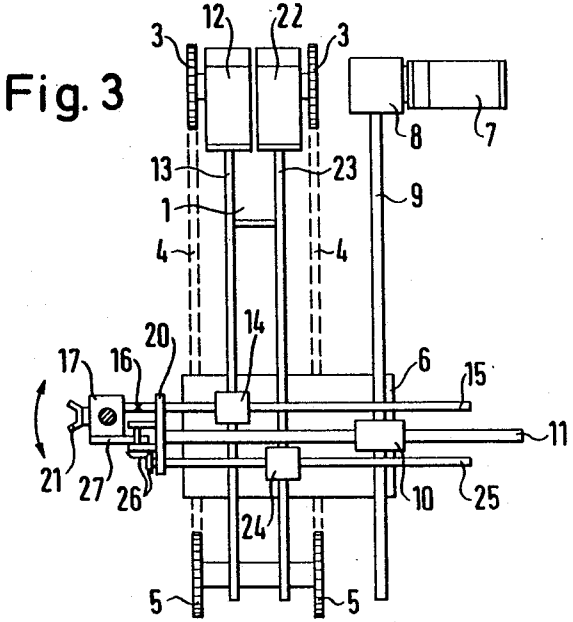
FIG. 3 is a diagrammatic front elevational view of the apparatus of FIG. 2.
Figure 4:
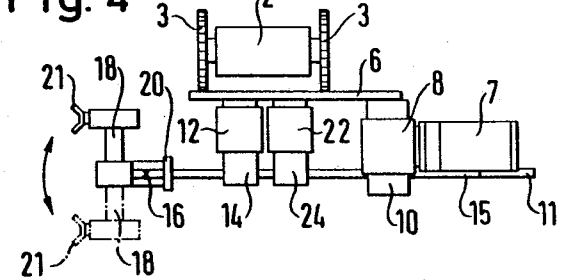
FIG. 4 is a diagrammatic top plan view of the apparatus of FIG. 2.

The apparatus shown diagrammatically in FIGS. 2–4 is used for coating one side of a vehicle body. Similar apparatus is used for coating the opposite side of the vehicle body. The side coating apparatus includes a stationary electric motor 1 (FIGS. 2 and 3) which is connected through a transmission 2 (FIG. 4) for rotating two spaced chain sprockets 3 about a common axis. Two spaced apart chain sprockets 5 are spaced from the sprockets 3 and are mounted to rotate freely about a common axis. Two chains 4 are provided in parallel planes, each of which is trained around one sprocket 3 and one sprocket 5. A carriage 6 is attached to the chains 4 for movement with the chains 4. The carriage 6 is suitably guided by vertical tracks (not shown) to be moved or reciprocated up and down along the Z axis by the motor 1. As will be explained below, one or more spray guns 21 are mounted on the carriage 6 for movement along the Z axis with the carriage 6.

A stationary electric motor 7 is coupled to drive a transmission 8 which is supported on a suitable stationary frame (not shown). A splined output shaft 9 from the transmission 8 rotates about a vertical axis and is supported to extend substantially the distance between the sprockets 3 and 5. A 90° angle drive 10 mounted on the carriage 6 is keyed to slide on the vertical shaft 9 as the carriage 6 is reciprocated up and down by the motor 1. The angle drive 10 moves a horizontal shaft 11 axially back and forth in the direction of the X axis. A bracket 20 is attached to a free end of the horizontal shaft 11.

A third stationary motor 12 is mounted on the frame (not shown) of the apparatus. The motor 12 rotates a splined shaft 13 about a vertical axis. A 90° angle drive 14 mounted on the carriage 6 is keyed to be driven by the shaft 13 and to slide on the shaft 13 as the carriage 6 is reciprocated up and down by the motor 1. A splined horizontal shaft 15 is keyed to slide in an axial direction relative to the angle drive 14 and to be rotatably driven by the output of the angle drive 14. The shaft 15 is displaceable in the direction of the X axis as the shaft 11 is driven by the motor 7 to displace the bracket 20 along the X axis. A free end of the shaft 15 is coupled through a universal joint 16 to a worm gear train 17 which has an output shaft 18. A pivotal or rotational movement is imparted to the output shaft 18 as the shaft 15 is rotated. The axis of the output shaft 18 extends in the direction of the Y axis. The spray guns 21 are mounted on the output shaft 18 for rotation about an axis parallel to the Y axis as the shaft 15 is rotated by the motor 12.

A fourth stationary electric motor 22 is mounted on the frame (not shown) of the apparatus for driving a splined vertical shaft 23. The shaft 23 is coupled to a 90° angle drive 24 mounted on the carriage 6 to permit the angle drive 24 to slide on the shaft 23 as the carriage 6 is reciprocated up and down by the motor 1. The shaft 23 is keyed to drive the angle drive 24. The angle drive 24 has an output keyed to a splined horizontal shaft 25 to rotate the shaft 25 in response to rotation of the shaft 23 and to permit the shaft 25 to slide in an axial direction through the angle drive 24 as the bracket 20 is moved by the shaft 11. Two bevel gears 26 constituting a 90° bevel gear train connect a free end of the shaft 25 to rotate a base plate 27 mounted on the bracket 20 about a vertical axis which extends through the universal joint 16. The worm gear train 17 which supports the spray guns 21 is mounted on the base plate 27. As a consequence, the motor 22 rotates the base plate 27 and the spray guns 21 mounted thereon about an axis parallel to the Z axis.

From the above description, it will be apparent that the stationary explosion-proof electric motors 1 and 7, respectively, displace the spray guns 21 in directions extending along the Z and X axes. Further, the stationary explosion-proof motors 12 and 22, respectively, rotate or pivot the spray guns 21 about the Y and Z axes. The transmissions or gear drives 10, 14 and 24 are mounted on the carriage 6 to follow movement of the carriage 6. Because the transmission of forces and moments from the electric motors to the spray guns 21 is effected only by mechanical means, the use of movable hoses or cables for driving the apparatus is avoided. Owing to the use of stationary electric motors, the electric cables supplying the motors are fixed and not subject to breakage or damage which can cause an explosion.

Figure 5:
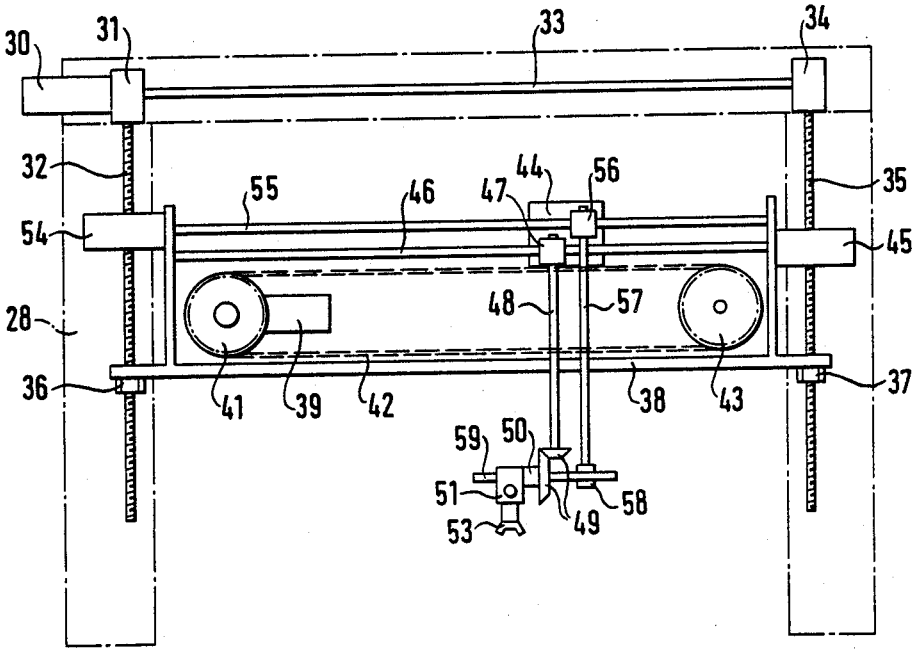
FIG. 5 is a diagrammatic front elevational view of contour following apparatus for spraying the top of a vehicle body in accordance with the invention.
Figure 6:
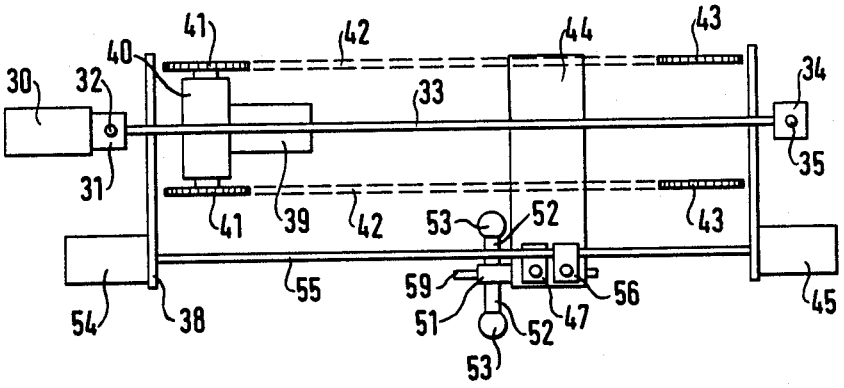
FIG. 6 is a diagrammatic top plan view of the apparatus of FIG. 5.

FIGS. 5 and 6 diagrammatically illustrate apparatus for coating the top of a workpiece such as a vehicle body. The apparatus includes a stationary explosion-proof electric motor 30 which is mounted on a frame 28 diagrammatically shown by dashed lines. The motor 30 is connected to an angle drive 31 mounted on the frame 28 which has a horizontal output shaft 33 and a vertical output shaft 32. The shaft 33 is connected to drive a 90° angle drive 34 mounted on the frame 28 which has a vertical output shaft 35. The vertical shafts 32 and 35 are in the form of screws having the same thread pitch and which are rotated about spaced apart vertical axes at the same speed by the motor 30 and the gear drives 31 and 34. The vertical shafts 32 and 35 are threaded into nuts 36 and 37, respectively, which are attached to a frame 38. As the shafts 32 and 35 are simultaneously turned in the nuts 36 and 37 by the motor 30, the frame 38 moves up or down along the Z axis, depending on the direction of rotation of the motor 30.

An explosion-proof electric motor 39 is secured to the frame 38 and is coupled to a transmission 40 (FIG. 6) for driving two chain sprockets 41. Two additional chain sprockets 43 are rotatably mounted on the frame 38 and are spaced in the direction of the X axis form the chain sprockets 41. Two chains 42 are trained around respective pairs of the chain sprockets 41 and 43. A carriage 44 is attached to the chains for movement along the X axis as the motor 40 drives the two chains. The carriage 44 may be guided for movement in the direction of the X axis by suitable tracks (not shown) mounted on the frame 38.

An explosion-proof electric motor 45 is mounted on the frame 38. The motor 45 has a splined output shaft 46 which is supported on the frame 38 to extend in the direction of the X axis. The shaft 46 is coupled to a 90° angle drive 47 which is mounted on the carriage 44. The angle drive 47 is keyed to slide on the shaft 46 as the carriage is reciprocated along the X axis by the motor 39. As the shaft 46 is rotated by the motor 45, a splined output shaft 48 from the angle drive 47 extending in the direction of the Z axis rotates. A bevel gear 49 attached to a lower free end of the shaft 48 meshes with a corresponding output bevel gear 49 that has an axis extending in the direction of the X axis. The output bevel gear 49 is connected to a tubular shaft 50, which carries an angle drive 51. The angle drive 51 has an output shaft 52 which extends transverse to the tubular shaft 50 and carries one or more spray guns 53. The electric motor 45 is operable to rotate the tubular shaft 50 about an axis parallel to the X axis via the shaft 46, the angle drive 47, the shaft 48 and the bevel gears 49. Together with the tubular shaft 50, the angle drive train 51, which is fixed to the tubular shaft 50, and the spray guns 53 are rotated about an axis parallel to the X axis.

As is shown in FIG. 5, a fourth explosion proof electric motor 54 is mounted on the frame 38. The motor 54 has a splined output shaft 55 supported on the frame 38 to extend in the direction of the X axis. The shaft 54 is coupled to a 90° angle drive 56 mounted on the carriage 44. As the carriage 44 moves along the X axis, the angle drive 56 slides on the shaft 55. When the motor 54 rotates the shaft 55, an output shaft 57 from the angle drive 56 is rotated about the Z axis. A gear 58 attached to a lower free end of the shaft 57 meshes with a rack 59 to move the rack 59 in an axial direction along the direction of the X axis. The rack 59 extends into the angle drive 51 and is coupled to its output shaft 52 which carries the spray guns 53. As the axis of the output shaft 52 extends in the direction of the Y axis, the rack 59 can rotate the output shaft 52 about an axis parallel to the Y axis so that the spray guns 53 connected to the output shaft 52 are pivoted or rotated about an axis parallel to the Y axis.

It is apparent that the four electric motors 30, 39, 45 and 54 for the top coating apparatus can displace the spray guns 53 in the directions of the Z axis and the X axis and can rotate t spray guns 53 about axes parallel to the X axis and the Y axis, respectively. The motor 30 is stationary mounted and the motors 39, 45 and 54 are mounted on the movable frame 38 for movement together in a vertical direction. The vertical movement of the frame 38 and the attached motors 39, 45 and 54 is strictly linear and is the slowest of all movements which may be performed by the top coating apparatus so that there is virtually no risk of a power cable breaking.

All electric motors for the side coating apparatus and the top coating apparatus are freely programmable. This means that they may be controlled individually and independently of each other in accordance with a desired program by an external control system (not shown). In this manner, the spray guns can be moved along optimum paths for the coating of different workpieces, for example, different style automobile bodies. Because the electric motors can be controlled individually and independently of each other, each motor imparts a movement only along or about one associated axis and does not influence movement along or about any other axis. For example, when the spray guns have been moved to a predetermined desired position, they will be held in that position throughout the linear movements along the Z axis for the side coating apparatus and along the X axis for the top coating apparatus as the workpiece is conveyed along the Y axis. Of course, the electric motors for imparting movements along or about a plurality of axes can be operated simultaneously in order to impart to the spray guns a desired compound movement along the contour of a vehicle body.

What is claimed is:

1. Improved contour following apparatus for positioning a paint spray gun for coating a workpiece moving along a predetermined path along a first axis comprising first, second, third and fourth explosion-proof electric motors, means responsive to said first motor for moving said spray gun along a second axis in a direction perpendicular to said first axis, means responsive to said second motor for moving said spray gun along a third axis in a direction perpendicular to said first and second axes, means responsive to said third motor for rotating said spray gun about an axis parallel to said second axis, means responsive to said fourth motor for rotating said spray gun about an axis parallel to said first axis, and wherein said second motor is stationary.

2. Improved contour following apparatus for positioning a paint spray gun for coating a workpiece moving along a predetermined path along a first axis, as set forth in claim 1, wherein said first, third and forth motors are mounted on a frame, and wherein said second motor is connected to move said frame along said third axis.

3. Improved contour following apparatus for positioning a paint spray gun for coating a workpiece moving along a predetermined path along a first axis, as set forth in claim 2, and further including a carriage mounted on said frame to move along said second axis, wherein said first motor is connected to move said carriage along said second axis, and wherein said spray guns are supported on said carriage for rotation about axes parallel to said first and second axes.

4. Improved contour following apparatus for positioning a paint spray gun for coating a workpiece moving along a predetermined path along a first axis, as set forth in claim 3, wherein said third and fourth motors are connected through angle drive means mounted on said carriage for rotating said spray gun about axes parallel to said first and second axes.

5. Improved contour following apparatus for positioning a paint spray gun for coating a workpiece moving along a predetermined path along a first axis comprising first, second, third and fourth explosion-proof electric motors, means responsive to said first motor for moving said spray gun along a second axis in a direction perpendicular to said first axis, means responsive to said second motor for moving said spray gun along a third axis in a direction perpendicular to said first and second axes, means responsive to said third motor for rotating said spray gun about an axis parallel to said second axis, means responsive to said fourth motor for rotating said spray gun about an axis parallel to said first axis, and wherein said first, second, third and fourth motors are stationary.

6. Improved contour following apparatus for positioning a paint spray gun for coating a workpiece moving along a predetermined path along a first axis, as set forth in claim 5, and further including a carriage, and wherein said first motor is connected to move said carriage along said second axis, and wherein said spray guns are supported on said carriage for rotation about axes parallel to said first and second axes.

7. Improved contour following apparatus for positioning a paint spray gun for coating a workpiece moving along a predetermined path along a first axis, as set forth in claim 6, wherein said third and fourth motors are connected through angle drive means mounted on said carriage for rotating said spray gun about axes parallel to said first and second axes.

* * * * *